US005447589A

United States Patent [19]

DeLangis

[11] Patent Number: 5,447,589

[45] Date of Patent: Sep. 5, 1995

[54] METHOD FOR CUTTING FABRICS, ESPECIALLY COMPOSITE FABRICS

[75] Inventor: Leo M. DeLangis, Lomita, Calif.

[73] Assignee: Rockwell International Corporation, Seal Beach, Calif.

[21] Appl. No.: 54,483

[22] Filed: Apr. 30, 1993

[51] Int. Cl.[6] ..... D03D 47/50

[52] U.S. Cl. ..... 156/88; 66/169 A; 66/172 R; 83/425.2; 428/193; 428/408

[58] Field of Search ..... 156/88; 66/169 A, 172 R; 428/193, 408; 83/425.2

[56] References Cited

U.S. PATENT DOCUMENTS 4,756,858 7/1988 Reifehourser et al. ..... 264/DIG. 69
5,075,057 12/1991 Hoedl ..... 264/DIG. 69
5,094,791 3/1992 Nopper ..... 264/112
5,304,410 4/1994 Welster ..... 428/913

*Primary Examiner*—James J. Bell
*Attorney, Agent, or Firm*—Terrell P. Lewis; Charles T. Silberberg

[57] ABSTRACT

A method of precision cutting fabric material while obtaining cleanly cut edges involves placing the material on a flat support surface, identifying one or more regions of material to be cut, placing adhesive tape on both sides of the material, and then using an appropriate tool to first squeeze the tape into the fabric at the cutting region, and effecting the cutting of the taped material. A reinforcing woven fabric constituent for incorporation into a metal matrix composite, produced by the method, is also disclosed.

16 Claims, 1 Drawing Sheet

METHOD FOR CUTTING FABRICS, ESPECIALLY COMPOSITE FABRICS

BACKGROUND OF THE INVENTION

1. Field Of the Invention

The present invention relates to the cutting of fabric materials, and more particularly to a method and apparatus for cutting mesh fabric materials so as to obtain cleanly cut edges which are also true to the shape intended where cutting has taken place.

2. Background of the Invention

Present day materials used for advanced design aerospace structures must exhibit exceptional structural strength characteristics, while at the same time permit significant reduction In overall weight. One class of these materials are typically referred to as "composites", and include both organic and metal reinforced matrices.

Reinforcing materials typically used in composites are provided as fibers. Generally, the fibers consist of materials such as metals, a combination of carbon and graphite, or ceramics. These fibers may be incorporated in a matrix material as randomly arranged pieces, as an ordered arrangement of tow, as an ordered mesh arrangement including one or more layers of the fibers, or as an arrangement of continuous fibers woven in a fabric.

One of the most difficult problems faced today In the use of fabric reinforcing materials is the cutting of the material so as to achieve a cleanly cut edge true to the angular curvilinear or straight line configuration intended to be formed.

Typically, the reinforcing fibers are stiffest in one direction (e.g. in the axial direction of the fibers themselves) and the soft cross-weave fibers (e.g., materials such as molybdenum and titanium-niobium) In the some other direction. As a result, the fabric material has a tendency not to lay flat or straight, and handling causes the soft cross-weave to shift, pinch or break. When the material is cut at any angle other than parallel to the axial direction of the reinforcing fibers, these problems are multiplied and the fabric material fails to behave in a manner conducive to attaining the desired result. In fact, the fabric material, cut in such an "off-axis" direction, typically yields an uneven, jagged edge and exhibits multiple breaks in the cross-weave fibers. The more acute the angle, the greater the problem.

The current practice of using a paper cutter or of cutting the material manually with a utility knife or scissors has consistently yielded undesirable results. In addition, such conventional techniques for cutting, when applied to this type of material, are time consuming, extremely cost inefficient and impractical, especially when working with larger size pieces (e.g., over two feet in length or width).

OBJECTS OF THE INVENTION

It is therefore an object of the present invention to provide a method for cutting mesh or fabric materials which will enable precision cutting of the material while obtaining cleanly cut edges, and which will overcome the drawbacks and disadvantages of the processes currently used for cutting this type of material.

Another object of the present invention is to provide a method for enabling efficient handling of a mesh or fabric material for preparation for subsequent working or manipulation of the material.

Still another object of the invention is to allow for a safer, less hazardous working environment while handling these types of materials by eliminating, as best possible, loose reinforcing fibers or cut particles which could lodge or become embedded in a worker's hand during such handling.

These and other objects are accomplished by essentially arranging the material on a flat support surface, identifying the region(s) of material to be worked by cutting, placing adhesive tape on both sides of the material, and then using an appropriate tool to first squeeze the tape into the fabric material at the cutting region, and then effect the cutting of the taped material. Preferably, conventional or automatic sheet metal equipment will be selected as the tool used for cutting the material.

DETAILED DESCRIPTION OF THE INVENTION

Figure 1:
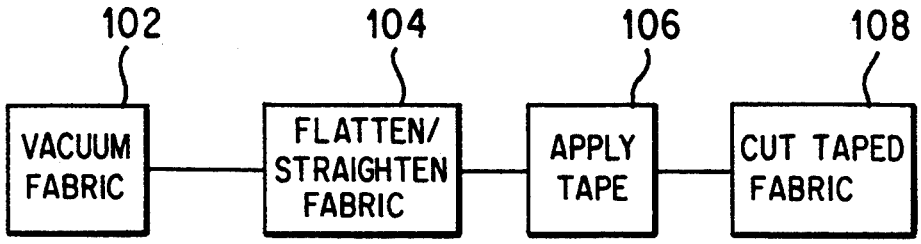
FIG. 1 is a schematic flow chart depicting the steps of the process of the present invention.

Referring now to the schematic flow chart of FIG. 1, it can be seen that the process of the present invention involves the following series of steps:

(1) a first step 102 in which the fabric to be cut is vacuumed, (2) a second step 104 of flattening and straightening out the fabric, preferably in the direction of the stiff fibers as well as in the direction of the soft cross-weave, (3) a third step 106 of applying a low-, or non-, contaminating adhesive tape on a first surface of the fabric and then applying adhesive tape to the opposite surface of the fabric, (4) a fourth step 108 of cutting the taped sheet of fabric with a conventional or automatic sheet metal machine.

In the first method step 102, loose particles of dust, debris, or other contamination are removed from both surfaces of the fabric, as for example, by vacuuming. Care must be taken to avoid damaging the fabric in this step.

The second step 104 of flattening and straightening the fabric serves the purpose of insuring that all of the material comprising the fibers and the cross-weave is respectively aligned, flattened and made parallel. Of particular importance is that the material strands of the cross weave be arranged perpendicular to the fibers.

The third step 106 of the method entails applying non-, or low-, contaminating adhesive tape on both surfaces of the fabric to be cut. A "low-contaminating" or "non-contaminating" adhesive tape is characterized by the fact that it leaves little, or no, adhesive residue, respectively, after its removal.

An example of this type of tape, which is contemplated for use with the process of the present invention, is available from and manufactured by Minnesota Manufacturing and Mining (3M) Company, and is Known as"3M #346 tape" available in 12" and 24" widths.

In accordance with the method of the invention, the tape is applied to both of the opposing surfaces of the fabric. In this way, each of the major, opposing sides of the fabric is covered with the tape.

Figure 2:
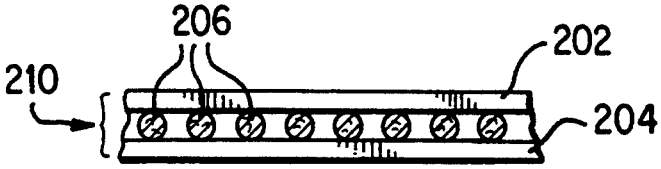
FIG. 2 depicts a piece of woven fabric including a layer of tape on each side thereof.

FIG. 2 of the drawings shows an upper layer of tape 202 and a lower layer of tape 204 of the type described above after application to a single layer 206 of SCS-6 woven fabric. Following application of the tape to the woven fabric, the once flimsy material becomes a stiffened fabric assembly 210 that can be handled or manipulated in the same manner as a conventional piece of sheet metal.

Figure 3:
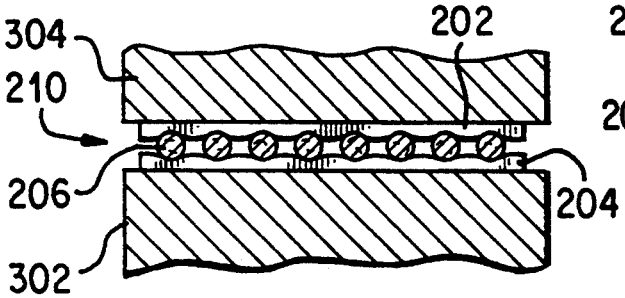
FIG. 3 shows the taped fabric of FIG. 2 disposed between a cutter apparatus and a die.
Figure 4:
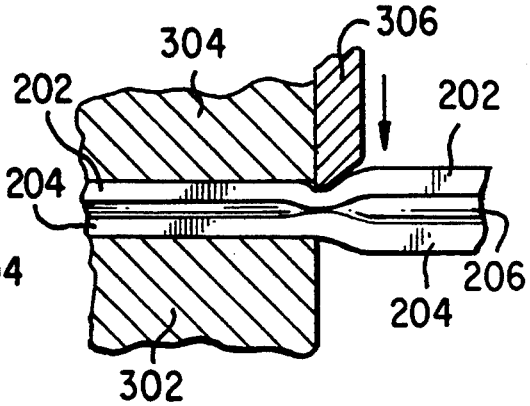
FIG. 4 is a side view of the cutter apparatus and die of FIG. 3, showing a cutter element as it begins to penetrate the upper layer of adhesive tape, just before contacting the fibers to be sheared.
Figure 5:
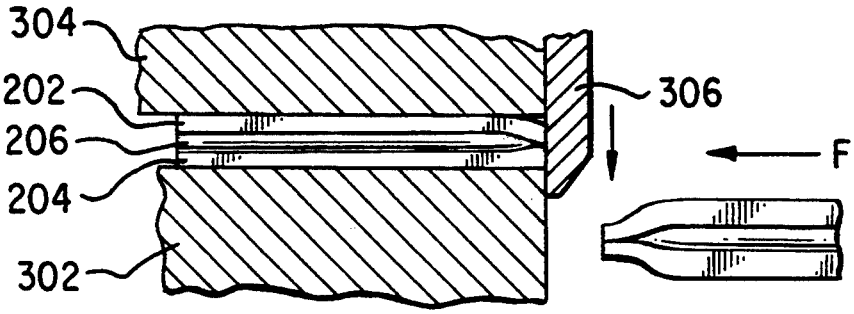
FIG. 5 is a side view of the cutter apparatus and die of FIG. 3, showing the cutter element after completing its severing stroke.

Referring now to FIGS. 3–5, the step of cutting the now-stiffened fabric assembly 210 entails first placing the taped fabric assembly on a lower die or support assembly 302 and disposing an upper die (also known as a shear pressure bar) or cutter assembly 304 atop the fabric assembly. Next, the upper die/cutter assembly 304 is moved toward the lower die/support assembly 302 at least in the vicinity of the region of the taped fabric assembly to be cut (see FIGS. 4 and 5) for the purpose of squeezing the taped fabric assembly between the cutter assembly and the die. In this way, the tape covering the opposing sides of the fabric assembly is forced into, and fills, the spaces between the fabric weave elements. Thereafter, a cutting element 306 of the cutter assembly is actuated to effect severance of a predetermined portion of the fabric assembly 210.

In carrying out this part of the method, various cutter assemblies could be used, as for example a sheet metal shear, or a manual or automatic punch press. These types of cutter assemblies are capable of performing straight or contoured clean cuts along the edges of the severed fabric portion(s) of the woven fabric. However, the invention also contemplates the use of any other similar cutter assemblies which provide the same or similar results, i.e., cleanly cut edges, as for example scissors or knife-type devices.

Figure 6:
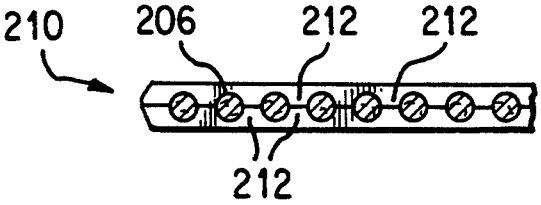
FIG. 6 illustrates the taped fabric material after the cutting operation has taken place, showing the tape squeezed between, and thereby maintaining the spaced positions of, the fibers.

Referring now to FIG. 6, there is shown an end view of the taped fabric assembly 210 after severance of a portion therefrom via downward severing movement of the cutter element 306 (note FIGS. 4 and 5). The view depicted in FIG. 6 is taken in the direction of arrow F shown in FIG. 5. As seen at 212 in FIG. 6, the tape, on opposite sides of the fabric assembly where cutting or severing has taken place, has been squeezed into the spaces between the fibers so as to hold the fibers of the weave in a fixed angular relationship. For example, where the fibers of the woven fabric are initially oriented at right angles to the cross-weave, they are secured at that perpendicular orientation by the flowing of the tape into the spaces between the crossed fibers and the ultimate deformation of the tape.

In accordance with practice of the method of the present invention, cuts exhibiting acute angles to the fiber direction have been demonstrated using the taping process of this invention, and with excellent edge quality (i.e., cleanly-cut, straight line or contoured edges). Forming holes and windows in the fabric taped according to the process of the present invention also can be easily attained, with excellent accuracy and cleanliness of the cut edges.

In practicing the method of the present invention, when the fabric surfaces covered with the adhesive tape are disposed between opposing upper and lower dies, the tape is pressed against the fiber construction of the fabric to effect a flowing of the tape into the spaces between the fabric fibers to thereby maintain the spacing between the fibers.

Further, in accordance with the preferred methodology of the present invention, cutting the fabric with a tool to form an edge entails squeezing opposite sides of the tape-covered fabric prior to, or in conjunction with, effecting a cut of the fabric so that the tape is pressed into the mesh formed by the woven fibers. After squeezing the tape into the spaces of the fiber weave, the cutting assembly or tool is used to sever the fabric in a predetermined pattern to remove a portion (or leave a window or space) having a predetermined configuration.

Of course, the invention contemplates a method in which a cutting tool may be used where the tape is generally not pressed between tile fibers, except at the point of cutting where tape pressing is inevitable. This limited amount of tape being squeezed into the spaces of the fiber weave is sufficient to maintain the spacing of the fibers prior to, and during, cutting.

The severed or removed portion, which will ultimately be used to form the composite component, can have a rectilinear, straight edged configuration (e.g., a polygonal shape), a curvilinear configuration, or any combination of the two. The removed portion may also include a preexisting fabric edge.

By practicing the method of this invention, extremely economical use of the expensive silicon-carbide fabric can be achieved due to a significant reduction of edge scrap. Moreover, the method of the present invention enables ease of disposal of edge fragments which become trapped between the two layers of tape as well as stiffened trimmed-away areas. In contrast, in the conventional methods, small loose edge fragments fall on the floor or on tables where they become hazardous.

After the desired portions of the taped fabric assembly 210 have been severed, there results a fabric layer having a predetermined configuration. For use in composite layup applications, the tape is removed from opposing faces of the fabric layer. Thereafter, composite structure fabrication can be achieved using fabric layers disposed one atop another with a layer of metallic foil material sandwiched between opposing fabric layers. The resulting consolidated composite component exhibits a three-dimensional configuration of either planar or non-planar shape or contour.

While certain representative embodiments and details have been shown for the purpose of illustrating the invention, it will be apparent to those skilled in this art that various changes and modifications may be made therein without departing from the spirit or scope of this invention.

What is claimed is:

1. A method for cutting reinforcing fibers woven as a fabric, where the edges of the subsequently cut fabric along the length of the cut are clean and continuous, comprising:

smoothing and flattening the fabric, covering one surface of the fabric with a layer of adhesive tape, and cutting through said fabric and said adhesive tape covering said one surface of said fabric with a tool to form at least one clean and continuous edge along the length of the cut.

2. The method of claim 1, wherein after covering said one surface of the fabric with a piece of adhesive tape, further including the steps of turning said fabric over, covering a portion of the opposite surface of the fabric which overlies the one surface with a second layer of said adhesive tape, and cutting through said fabric and both pieces of said adhesive tape.

3. The method of claim 1, wherein said fabric comprises silicon carbide material fibers.

4. The method of claim 2, wherein said at least one clean and continuous edge is linear.

5. The method of claim 2, wherein said at least one clean and continuous edge is curvilinear.

6. The method of claim 2, wherein said tool is an automated tool.

7. The method of claim 2, wherein said tool is a conventional hand tool.

8. The method of claim 2, wherein said steps of covering said fabric surfaces with said adhesive tape include pressing said tape against said fabric to cause said tape to flow into the spaces between the fabric fibers and thereby maintain the spacing between the fibers.

9. The method of claim 2, wherein said step of cutting said fabric with a tool to form at least one edge includes squeezing opposite sides of said tape-covered fabric prior to cutting the fabric so that said tape is pressed into the mesh of said woven fibers.

10. The method of claim 8, wherein after squeezing opposite sides of said tape-covered fabric, said fabric is cut several times in a predetermined manner to remove a portion thereof having a predetermined configuration.

11. The method of claim 10, wherein said portion has a rectilinear configuration.

12. The method of claim 10, wherein n said portion is polygonal in configuration.

13. The method of claim 12, wherein said polygonal configuration is a square.

14. The method of claim 13, wherein said polygonal configuration a rectangle.

15. The method of claim 10, wherein said portion has a curvilinear configuration.

16. The method of claim 10, wherein said portion includes a preexisting edge of said fabric.

* * * * *